United States Patent [19]

Wildfeuer

[11] Patent Number: 5,074,428

[45] Date of Patent: Dec. 24, 1991

[54] SYNTHETIC RESIN FOR BLOW-MOLDED SYNTHETIC RESIN BARRELS

[76] Inventor: Eberhard Wildfeuer, Tannenweg 23, D-5430 Montabaur-Reckenthal, Fed. Rep. of Germany

[21] Appl. No.: 603,809

[22] Filed: Oct. 26, 1990

[30] Foreign Application Priority Data

Oct. 26, 1989 [DE] Fed. Rep. of Germany ..... 3935693

[51] Int. Cl.[5] ..... B68D 51/16

[52] U.S. Cl. ..... 220/322; 220/378; 220/614

[58] Field of Search ..... 220/319, 614, 378, 322

[56] References Cited

U.S. PATENT DOCUMENTS

| | | | |
|---|---|---|---|
| 1,988,824 | 1/1935 | Austin | 220/614 |
| 3,181,722 | 5/1965 | Huston | 220/378 |
| 3,215,304 | 11/1965 | Rohg | 220/378 |
| 3,532,244 | 10/1970 | Yates, Jr. . | |
| 3,696,962 | 10/1972 | Fehres | 220/378 |
| 3,790,020 | 2/1974 | Fine | 220/378 |
| 3,858,752 | 1/1975 | Marvin, Jr. et al. | 220/378 |
| 4,149,578 | 4/1979 | Hickey | 220/378 |
| 4,267,940 | 5/1981 | Wade | 220/378 |

FOREIGN PATENT DOCUMENTS

| | | |
|---|---|---|
| 1950164 | 11/1966 | Fed. Rep. of Germany . |
| 8131915 | 10/1981 | Fed. Rep. of Germany . |

*Primary Examiner*—Joseph Man-Fu Moy
*Attorney, Agent, or Firm*—Young & Thompson

[57] ABSTRACT

Such synthetic resin lids comprise an outer rim (4) encompassing the barrel neck (3) and an inner rim (5) entering into the barrel neck (3) and projecting beyond the lid bottom (6) below the barrel opening, as well as a sealing ring inserted between the outer rim (4) of the lid and the inner rim (5) of the lid. This sealing ring is urged by means of a clamping ring (10) or tightening wire against the opening rim (14) of the barrel neck (3), the clamping ring (10) or tightening wire extending over a flange (110 or flange sections molded to the outer rim (4) of the lid at the bottom and extending underneath a solid border (120 which latter protrudes radially toward the outside at a spacing below the barrel opening from the barrel wall. This border can be designed as a continuously extending flange or can be subdivided into flange sections. An axially projecting annular web (8) is molded to the base of an annular chamber (7) formed by the outer and inner rims (4 and 5, respectively) of the lid. This annular web, when the lid (1) is closed, transmits axial forces caused by stacking, dropping, etc. directly into the barrel neck (3). Sealing rings (13) are arranged on both sides of the annular web (8) which rings, when the lid (1) is closed, rest with pretensioning on the opening rim (14) of the barrel neck (3).

7 Claims, 3 Drawing Sheets

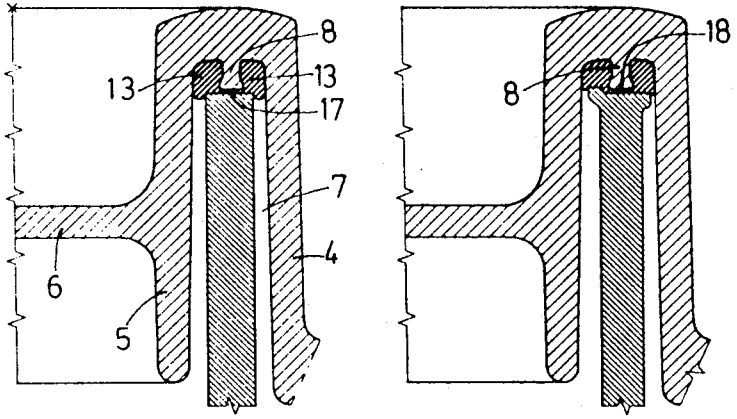
Fig. 5
Fig. 6
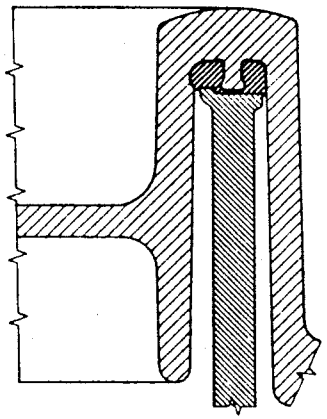
Fig. 7
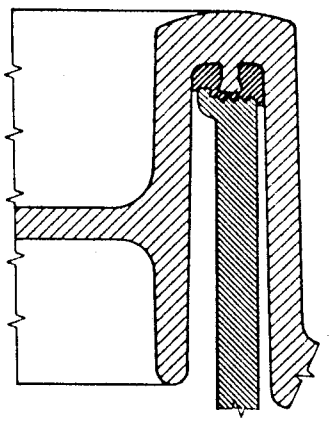
Fig. 8
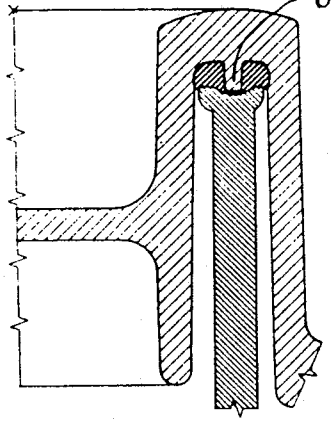
Fig. 9
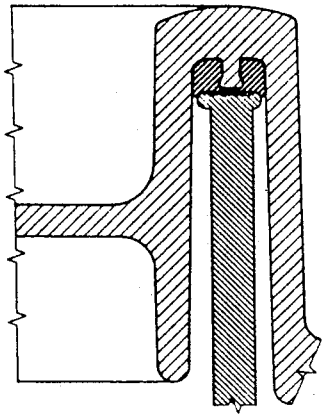
Fig. 10
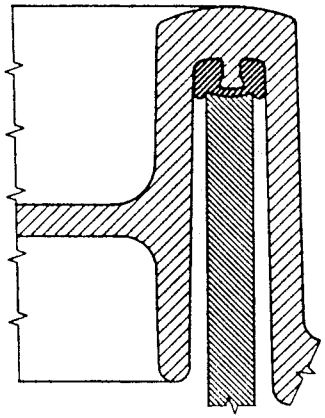
Fig. 11
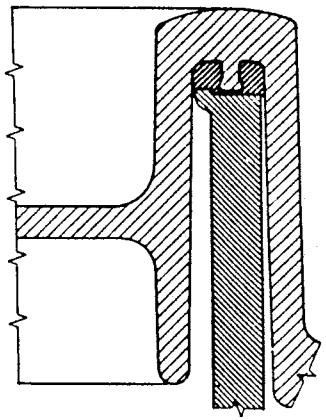
Fig. 12

SYNTHETIC RESIN FOR BLOW-MOLDED SYNTHETIC RESIN BARRELS

The invention relates to a synthetic resin lid for blow-molded synthetic resin barrels, with an outer rim surrounding the barrel neck and with an inner rim entering into the barrel neck and projecting past the lid bottom below the barrel opening, as well as with a sealing ring inserted between the outer lid rim and the inner lid rim, this sealing ring being urged against the opening rim of the barrel neck by means of a clamping ring or tightening wire, wherein the clamping ring or tightening wire extends over a flange or flange sections molded to the bottom of the outer rim of the lid and extends underneath a solid border which latter protrudes radially toward the outside at a spacing below the barrel opening from the barrel wall, this border being designed as a continuously extending flange or being subdivided into flange sections.

In such a lidded barrel, known from DE 2,544,491 C 2, stacking forces and axial impact forces occurring during dropping are transmitted to the barrel border via the outer flange formed at the lower rim of the lid. Considerable bending moments are produced thereby so that there is the danger of damage to the lid flange and/or the barrel border, as well as to the clamping ring, and the barrel becomes leaky and useless.

The invention is based on the object of providing a synthetic resin lid which is improved with regard to its functional safety.

This object has been attained according to the invention by the features of claim 1.

Suitable further developments of the invention are characterized in the dependent claims.

The synthetic resin lid of this invention is distinguished by the following advantages:

Stacking stresses and axial stresses occurring suddenly, for example when dropping from a height, are directly transmitted into the barrel jacket via the lid while the gasket is not overstressed at any location and thus exerts a uniform sealing effect. As a result, neither the outer flange at the lower lid rim nor the barrel border are exposed to bending stresses. The sealing arrangement of the lid can be utilized for barrels with a clamping ring lid closure or with a tightening wire lid closure. On account of the always constant pretensioning in the sealing rings, fatigue of the sealing ring material is prevented and therefore a permanent sealing action is achieved. In case of an unexpected damage to a sealing ring of the tandem gasket, leakproofness is still ensured at all times by the second sealing ring.

The invention will be described below with reference to a wide-necked barrel with clamping ring closure and a barrel with tightening wire closure. In the drawings:

FIGS. 5 through 12 show various embodiments of the lid gasket.

Figure 1:
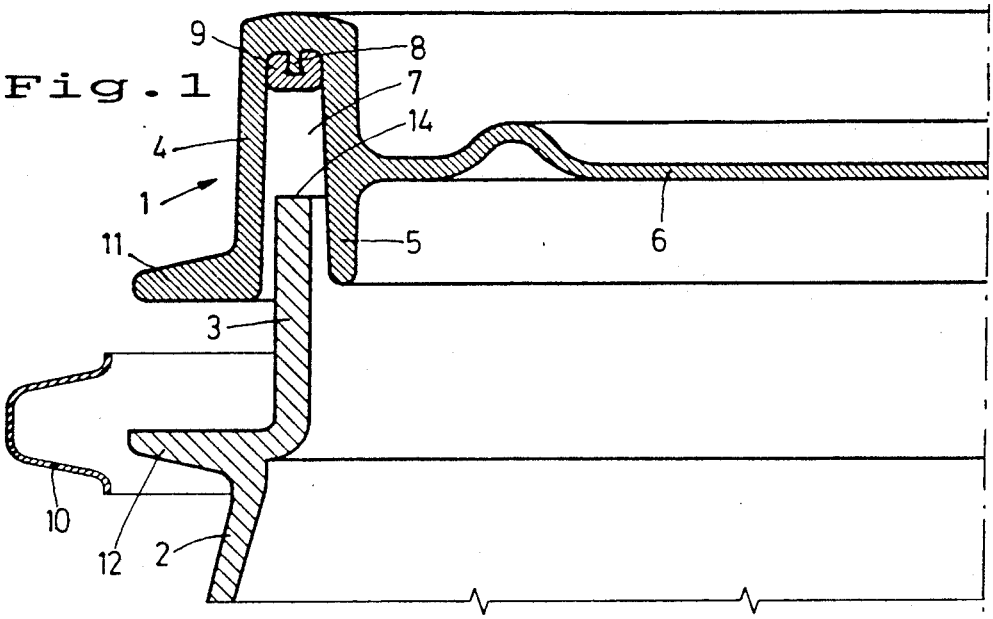
FIGS. 1 and 2 show the barrel neck region of a wide-necked barrel with clamping ring closure and continuously extending barrel border, namely, in FIG. 1, in the opened condition and, in FIG. 2, in the closed condition.

A lid 1 injection-molded of a synthetic resin, in accordance with FIGS. 1 and 2, for a wide-necked barrel 2 exhibits an outer rim 4 encompassing the barrel neck 3 and an inner rim 5 entering into the barrel neck 3, this inner rim projecting beyond the lid bottom 6 below the barrel opening. The outer and inner lid rims 4, 5 form an annular chamber 7, an annular web 8 projecting axially from the bottom of this chamber. According to FIG. 1, the annular web 8 is surrounded by a molded-on bicomponent sealing compound 9, for example polyurethane with curing agent.

Figure 2:
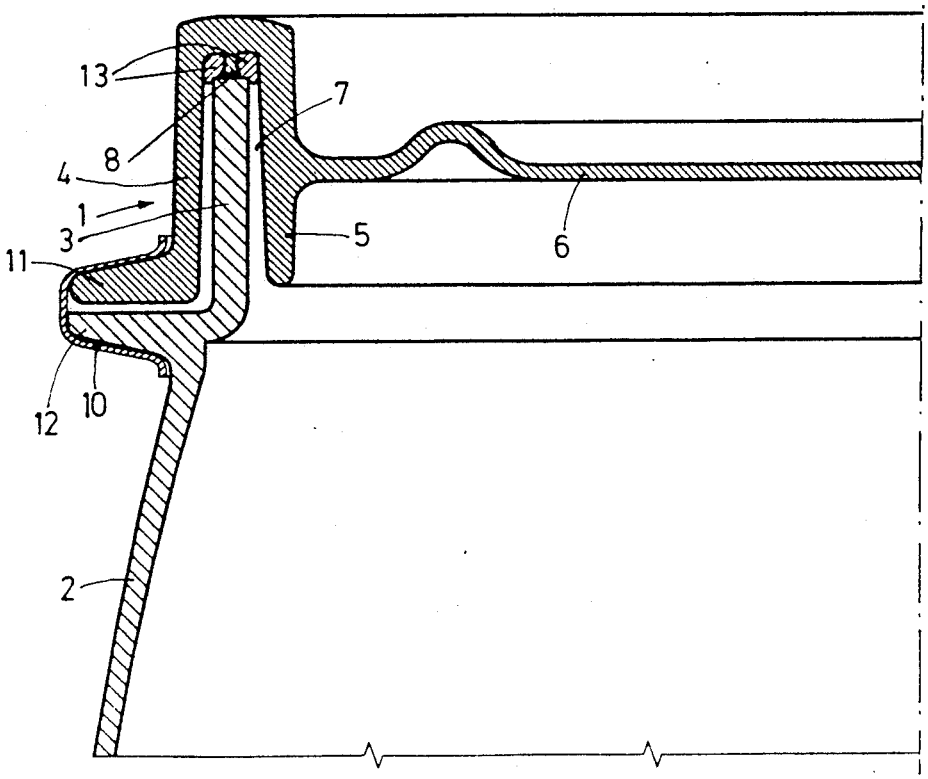

During closing of the lid 1 by means of a clamping ring 10, which latter extends over a continuous flange 11 molded at the bottom to the outer lid rim 4 and subtends a solid border 12 projecting from the barrel wall radially toward the outside at a spacing below the barrel opening, the annular web 8 is pressed onto the opening rim 14 of the barrel neck 3, with subdivision of the sealing compound 9 into two sealing rings 13, the sealing rings 13 being pretensioned past the opening rim 14 (FIG. 2). With the clamping ring 10 being closed, the flange 11 and the border 12 are not in contact with each other so that axial forces acting on the lid 1 are transmitted safely and directly into the barrel neck 3 and thus into the barrel body.

Figure 3:
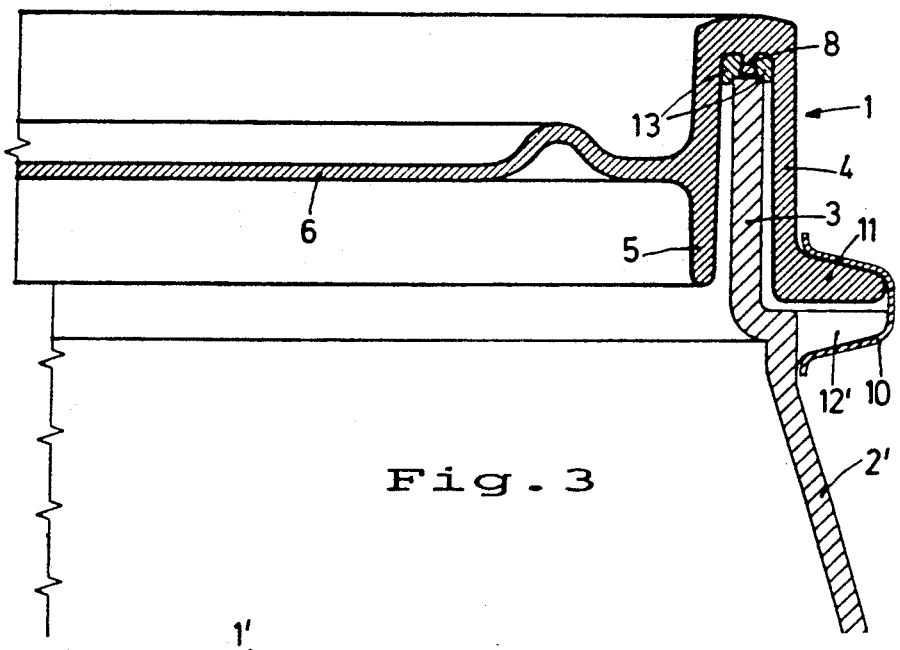
FIG. 3 shows the same barrel neck region of a barrel with interrupted border.

FIG. 3 shows the same lid 1 for a wide-necked barrel 2' wherein the border 12' is designed in the form of flange sections.

Figure 4:
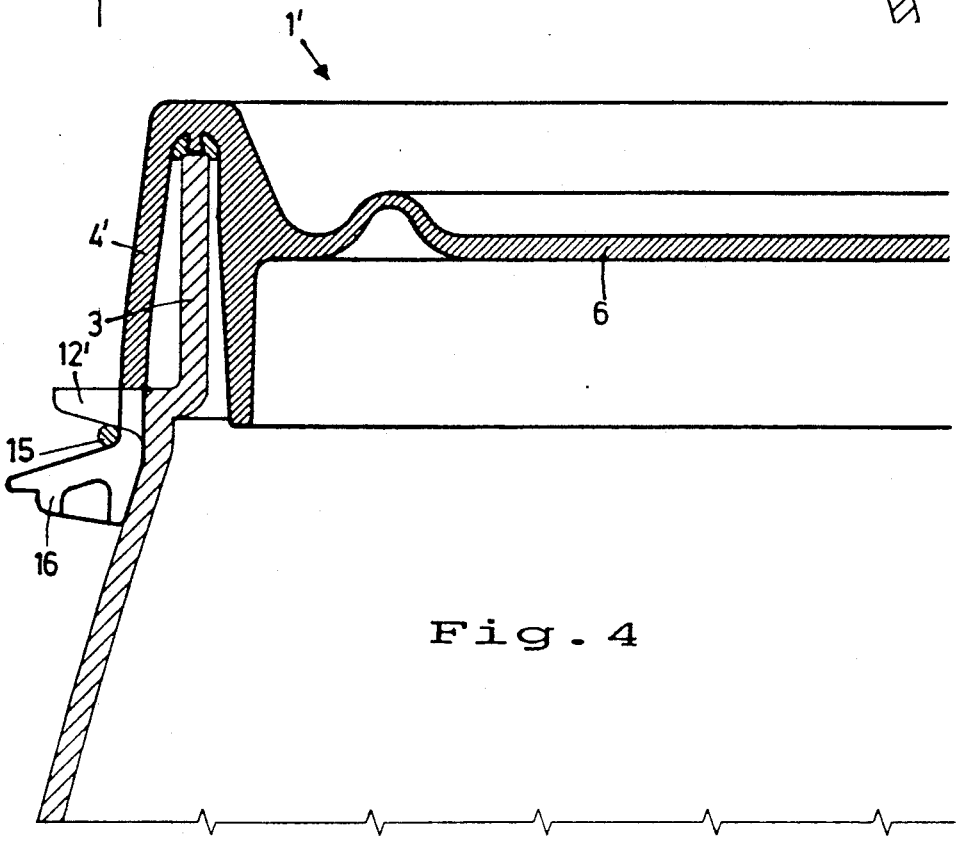
FIG. 4 shows the barrel neck region of a wide-necked barrel with tightening wire closure.

FIG. 4 shows a lid 1' with the same gasket arrangement for a wide-necked barrel 2' having the same border 12' subdivided into flange sections. A tightening wire 15 utilized for closing the lid 1' subtends the flange sections of the border 12' and extends over flange sections 16 molded at the bottom to the outer lid rim 4', the outer lid rim 4' penetrating the interspaces between the flange sections of the border 12', and the flange sections of the border 12' as well as the flange sections 16 of the outer lid rim 4' forming wedge-shaped contact surfaces for the tightening wire 15.

In the embodiments of the sealing arrangement according to FIGS. 5–12, the two sealing rings 13 are joined by way of a thin connecting web 17. The embodiments of the sealing arrangement according to FIGS. 5 through 8 and 10 through 12 each show a lid with an annular web 8 exhibiting a broadened supporting surface 18. In the gasket arrangement according to FIG. 9, the supporting surface 18 is defined by the width of the annular web 8.

FIGS. 5–12 show furthermore various design possibilities for the opening rim of the barrel neck for the mounting of the sealing rings 13 and/or their connecting web 17.

A labyrinth-like seal is obtained for the lid 1 or 1' by means of a profiled, e.g. serrated (FIG. 8) or undulated (FIG. 10) design of the opening rim.

I claim:

1. Synthetic resin lid for blow-molded synthetic resin barrels, with an outer rim encompassing the barrel neck and an inner rim entering into the barrel neck and projecting beyond the lid bottom below the barrel opening, as well as with a sealing ring inserted between the outer lid rim and the inner lid rim, this sealing ring being urged by a clamping ring or tightening wire against the opening rim of the barrel neck, the clamping ring or tightening wire, respectively, extending over a flange or flange sections molded to the outer rim of the lid at the bottom and subtending a solid border which latter protrudes radially toward the outside from the barrel wall at a spacing below the barrel opening and is fashioned as a continuous flange or is subdivided into flange sections.

characterized in that an annular web (8) projecting axially from the base of the annular chamber (7) constituted by the outer lid rim and inner lid rim (4 and 5, respectively) is molded-on, for introduction of axial forces, caused with the lid (1) being closed by stacking, dropping, etc., directly into the barrel neck (3); and that sealing rings (13) are arranged on both sides of the annular web (8) which, with the lid (1) being closed, rest with pretensioning on the opening rim (14) of the barrel neck (3).

2. Lid according to claim 1, characterized in that, in case of such a lid with clamping ring closure, the flanges (11, 12), with the lid (1) being closed, exhibit a spacing from each other.

3. Lid according to claim 1, characterized in that the sealing rings (13) are joined together in the zone of the annular web (8) between the latter and the opening rim (14) of the barrel neck (3) by way of a thin connecting web (17).

4. Lid according to one of claim 1, characterized in that the annular web (8) exhibits a broadened supporting surface (18).

5. Lid according to one of claim 1, characterized in that the supporting surface (18) is defined by the web width.

6. Lid according to one of claim 1, characterized in that the sealing rings (13) of a synthetic resin, for example polyurethane, are formed in place by injection molding.

7. Lid according to one of claim 1, characterized by prefabricated, inserted sealing rings (13).

* * * * *